United States Patent [19]

Ross

[11] Patent Number: 4,703,910

[45] Date of Patent: Nov. 3, 1987

[54] HANDS FREE PALETTE

[75] Inventor: Robert N. Ross, Herndon, Va.

[73] Assignee: The Joy of Painting, Reston, Va.

[21] Appl. No.: 899,632

[22] Filed: Aug. 25, 1986

[51] Int. Cl.[4] ..... A47B 97/04

[52] U.S. Cl. ..... 248/463; 248/449

[58] Field of Search ..... 248/441.1, 447, 448, 248/449, 453, 455, 460, 461, 462, 463, 464, 465; 108/15

[56] References Cited

U.S. PATENT DOCUMENTS

| | | | |
|---|---|---|---|
| 289,700 | 12/1883 | Parker | 248/441.1 |
| 625,271 | 5/1899 | Lang | 248/297.2 X |
| 1,136,005 | 3/1915 | Gumbew | 248/297.2 |
| 2,984,443 | 5/1961 | Bergengren | 248/453 |
| 3,095,834 | 7/1963 | Killen | 108/15 |
| 3,202,471 | 8/1965 | Wilson | 248/461 X |
| 3,368,786 | 2/1968 | Bulman | 248/465 X |
| 3,926,398 | 12/1975 | Vincent | 248/458 X |
| 4,109,892 | 8/1978 | Hartung | 248/458 X |
| 4,355,779 | 10/1982 | Heled | 248/460 |
| 4,453,470 | 6/1984 | Capella | 248/464 X |
| 4,610,414 | 9/1986 | Schuck | 248/464 X |

*Primary Examiner*—J. Franklin Foss

*Attorney, Agent, or Firm*—Larson and Taylor

[57] ABSTRACT

A palette for use by an artist which may be adjustably attached to a standard easel such that it may be easily adjusted to varying heights. The palette surrounds the support post of the easel on three sides and includes holes and concave indentations for use in storing tools and mixing paints. The present disclosure also embodies an easel employing this palette.

5 Claims, 1 Drawing Figure

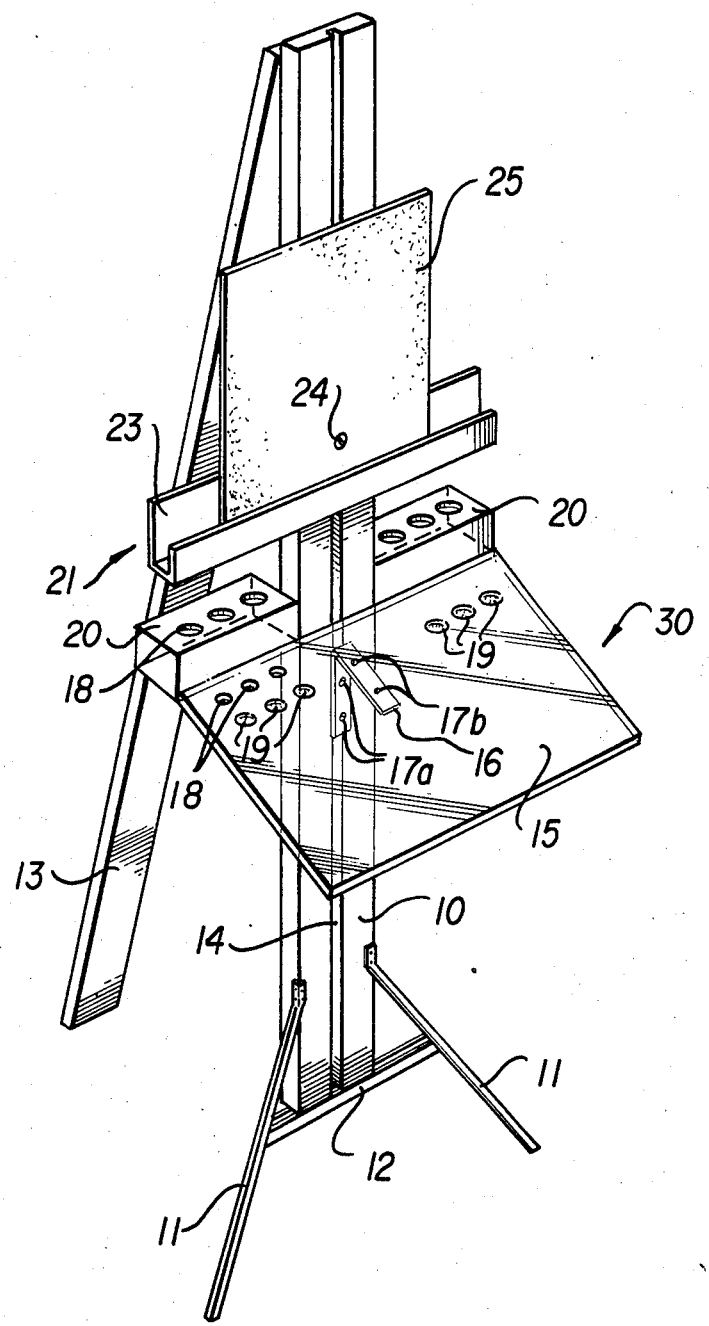
25
24
23
20
21
20
30
19
18
17b
19
17a
16
18
15
13
10
14
11
12
11

HANDS FREE PALETTE

FIELD OF THE INVENTION

The invention relates to a new and improved palette for use with an easel of the type used by artists and others for supporting a canvas or the like.

BACKGROUND OF THE INVENTION

Artists have always used easels to support their canvas, sketch pad, etc. while drawing or painting pictures. Using this conventional technique, the artist holds a paint brush in one hand, a palette in the other hand, and stands upright in front of an easel. However, this conventional technique has several disadvantages. First, unless the easel is an adjustable easel, the artist must remain standing while he is painting. Also, the artist will have both hands occupied, thus limiting his overall mobility. In addition, an artist may need to use several different tools for a single piece of work. The conventional technique provides no place to place these tools and mix his paints.

Prior solutions to these problems have not been completely satisfactory. For instance, U.S. Pat. No. 1,225,642 (Jones) discloses a folding easel which incorporates a shelf. This shelf solves some of the foregoing problems but it does not provide an ideal place to mix paints. U.S. Pat. No. 1,782,118 (Cahall) discloses a stretchable easel for different sized canvases which includes a support for a shelf thereon. This easel does not provide a place for paint mixing either. U.S. Pat. No. 518,544 (Faint) discloses an easel with a shelf, but the shelf cannot be used as a palette.

SUMMARY OF THE INVENTION

The present invention relates to a palette for use with an easel which comprises a thin planar platform having a slot therein, and a means for attaching the palette to an easel. Generally, easel posts include a channel which runs the length of the post into which channel mechanical fasteners may be engaged. This allows for attachment of the palette at any point along the easel post. This attachment is not permanent so that the palette may be adjusted to the desired height by the user.

The palette itself may include one or more concave indentations wherein paint may be mixed. The palette is designed so that it surrounds the easel post on three sides in order to provide additional storage space. Also, the palette is preferably constructed from a transparent material so that the artist may mix his paints against any color background that he desires.

The present invention also relates to an easel having at least one leg to support it, a post attached to the supporting leg, a means for supporting a canvas or sketch pad, a palette removably attached to said post, and a means for attaching the removable palette to the post such that the palette may be adjusted to different heights at the discretion of the user.

The primary object of the present invention is to provide a palette which is adjustable, convenient, inexpensive and easy to use.

Yet another object of the present invention is to provide an easel with an attached adjustable palette that gives an artist the facilities needed to mix paints and store tools.

It is a further object of the present invention to provide an easel at which an artist may either stand or sit.

These and other objects of the invention will become more apparent from the detailed description to follow.

BRIEF DESCRIPTION OF THE DRAWINGS

FIG. 1 is a perspective view of an easel with a palette attached thereto.

DETAILED DESCRIPTION OF THE PREFERRED EMBODIMENT

Referring more specifically to the drawing, the easel of the present invention is composed of a central post 10 which serves to support the easel and all of its attachments. Attached to the central post 10 are a pair of short legs 11 which rest on the ground and form two legs of a tripod that supports the central post 10 on a generally level surface. These two legs are given additional strength by a pair of horizontal beams 12 which connect the two short legs 11. The horizontal beams 12 are attached to the bottom of the central post 10 and thereby aid in supporting this post 10. The third leg of the support tripod is formed by the long leg 13 which extends from the top of the central post 10 all the way to the ground.

The central post 10 of the easel includes a channel 14 which extends the length of the post 10. This channel 14 is adapted to engage mechanical fasteners at any point along its length. A palette 30 is attached to the post 10 by a bracket 16. Two screws **17*a* screw into the channel 14 in the post 10, and two screws 17*b* screw into the palette platform 15. This method of attachment allows the user to adjust the palette 30** up and down at will so that the user may sit or stand while using the easel.

In the preferred embodiment the platform 15 includes several holes 18 therein into which tools may be inserted for storage. Also, the platform 15 has several concave indentations 19 which are used for storage of small items or for mixing paints. These storage holes and indentations provide a very convenient workplace for the artist. The ability to raise and lower the palette to a height suitable for the artist adds to the convenience of this device.

The palette 30 wraps around the central post 10 as shown in the figure. In the preferred embodiment the part of the palette 30 that wraps around the central post 10 is raised above the platform 15 and forms tiers 20. These tiers provide additional storage surface and also provide a clear reach for the user over the other items resting on the platform 15, to the items stored on the tiers 20. Also, this wrap around area provides enough additional space to allow the artist to get closer to the easel since the platform space in front of the easel may be reduced without compromising the size of the palette.

Attached to the central post 10 is a means for supporting a canvas 25. In the preferred embodiment this consists of a runner 21 composed of a front lower flange 22 and a rear higher flange 23. The lower edge of the canvas 25 is inserted between the flanges 22 and 23 and is held in place by the runner 21. The runner 21 is attached to the central post 10 by a single screw 24 which engages the channel 14. This allows the runner 21 to be removable and adjustable in the same manner as the palette 30.

The palette 30 is preferably fabricated from a transparent material such as plexiglass. This provides the artist with a clear view of the paints he is mixing in the concave indentations 19 of the palette 30. The artist may also put a backdrop of any color behind the clear plexiglass palette 30 in order to contrast or compare that color with the color of the paint he is mixing. This smooth, clear surface is easy to clean. Further, since the surface is clear, the artist can readily tell if the surface is clean enough to mix paint without the risk of undesirable impurities becoming mixed in his paints.

In operation the artist attaches the palette 30 at the desired height on the central post 10 of a standard easel by the use of mechanical fasteners 17*a* and 17*b*. Then the artist places a canvas on the runner 21 and begins mixing his paints in the concave indentations 19. The artist also places his brushes and other tools of the trade either in the holes 18 or the platform 15 or tiers 20. At any time during set-up or during painting the artist may adjust either the height of his canvas or the height of the palette 30 simply by unscrewing the screws attached to the central post 10 and reattaching them at the desired height. Then the artist is ready to begin painting. He may change positions at any time simply by adjusting the palette 30 and the height of the canvas.

The foregoing is a description of the preferred embodiment of the invention. It is not to be construed as limiting the scope of the invention in any way. It will be apparent to one of ordinary skill in the art that numerous modifications may be made without departing from the spirit of the invention.

I claim:

1. In combination, and artist's easel and an adjustable palette-work platform, comprising:

an easel support having a plurality of legs for stabilizing the easel, said support structure having an upright front central post having a slot which runs vertically for substantially the length thereof, a canvas shelf mounted on the central post to support a canvas to be painted, a palette-work platform connected to the central post beneath the canvas support shelf, connecting means for adjustably connecting the palette-work platform to said central post such that its vertical location can be varied along the length of the central post, said palette-work platform comprising an essentially flat horizontal substantially transparent sheet, said palette-work platform having rear extensions extending rearwardly to both sides of the central post, said palette-work platform being essentially smooth in the forward portion thereof to provide an area to mix paints, and said palette-work platform having in the rearward portion thereof at least one opening therethrough to support tools, paint brushes and the like.

2. The invention of claim 1, further including a raised platform on the rear extensions on each side of the central post to provide additional storage areas.

3. The invention of claim 1, said connecting means comprising an L-shaped bracket having one leg connected to the bottom of the palette-work platform and the other leg connected into the slot in the central post.

4. The invention of claim 1, said palette-work platform further including, toward the rear portion thereof a plurality of concave recesses for mixing paints.

5. The invention of claim 1, said palette-work platform being generally rectangular in shape.

* * * * *